United States Patent [19]

Khan

[11] Patent Number: 5,067,836

[45] Date of Patent: Nov. 26, 1991

[54] LIPSTICK KEY CHAIN ATTACHMENT

[76] Inventor: Shahid H. Khan, 8950 Goodrich Rd. #307, Bloomington, Minn. 55437

[21] Appl. No.: 610,060

[22] Filed: Nov. 7, 1990

[51] Int. Cl.[5] ..... A45D 40/00; A45D 40/06; A45D 40/18

[52] U.S. Cl. ..... 401/52; 401/78; 401/195

[58] Field of Search ..... 401/78, 52, 195

[56] References Cited

U.S. PATENT DOCUMENTS 2,653,339 9/1953 Mureau ..... 401/52 X
3,306,266 2/1967 McCunney ..... 401/52 X
3,949,511 4/1976 Goldhaft .

FOREIGN PATENT DOCUMENTS 128664 8/1948 Australia ..... 401/78
217866 3/1957 Australia ..... 401/78
941363 1/1949 France ..... 401/195

*Primary Examiner*—Steven A. Bratlie

[57] ABSTRACT

A lipstick dispenser in which a rotary disk is connected to a tubular actuator to move a lipstick holder axially along a tubular housing. An apertured wall projects right angularly from the disk to form a handle and an attachment device for connecting the dispenser to a women's key chain.

1 Claim, 1 Drawing Sheet

LIPSTICK KEY CHAIN ATTACHMENT

BACKGROUND AND SUMMARY

This invention relates to a lipstick dispenser having an external apertured wall extending from one of its ends for attachment of the dispenser to a key chain. By attaching the lipstick dispenser to the key chain it becomes much easier to find the lipstick dispenser in a woman's purse; once the woman's finger touches the keys or key chain she knows she has found the lipstick depenser.

THE DRAWINGS

DESCRIPTION OF A PREFERRED EMBODIMENT OF THE INVENTION

Figure 1:
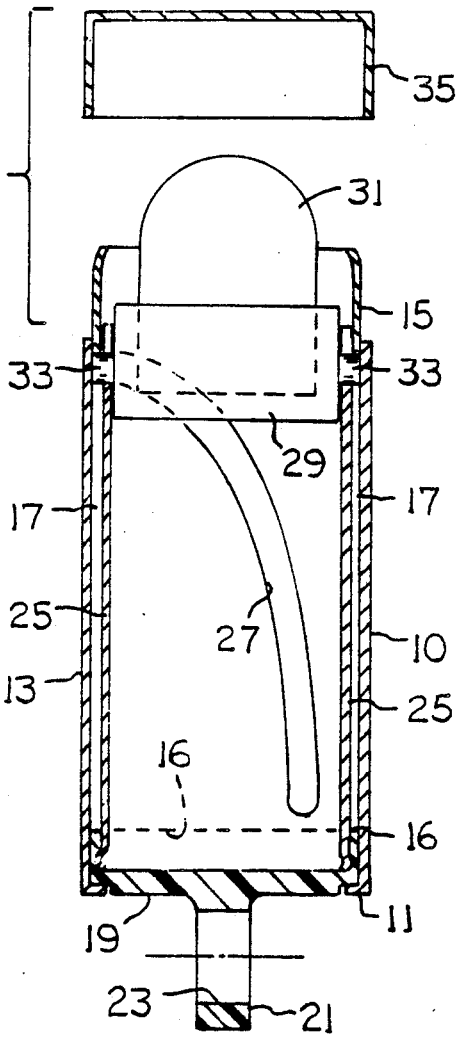
FIG. 1 is a longitudinal sectional view taken through a lipstick dispenser embodying the invention.
Figure 2:
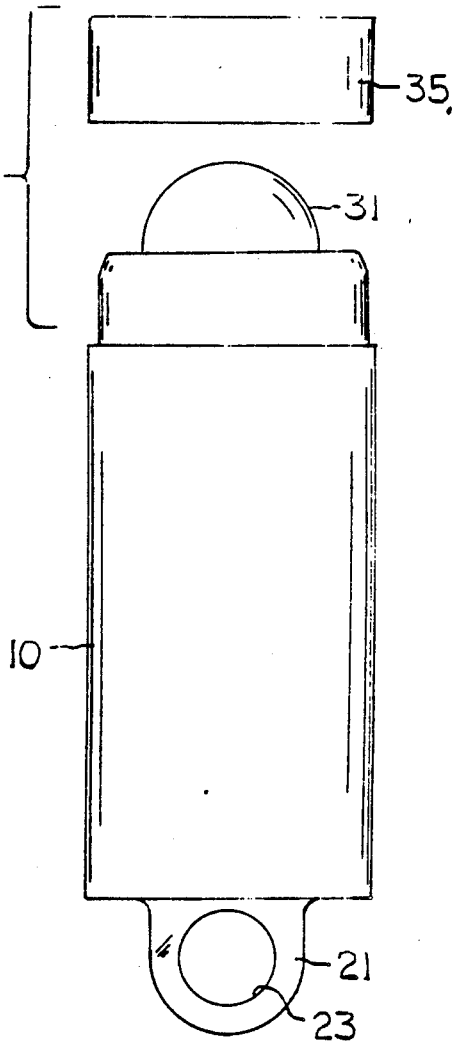
FIG. 2 is a side elevational view of the FIG. 1 dispenser.

The illustrated dispenser includes a two piece cylindrical tube 10 having an inturned flange 11 at its lower end. The tube includes an outer cylindrical sleeve 13 and an inner metal liner 15 press fit into the sleeve. The liner has one or two diametrically spaced axial slots 17 extending therealong. When the liner is press fit into the sleeve the slots form axial grooves in the defined tube 10. The lower end 16 of liner 15 is spaced above flange 11 to form an internal circumferential groove at the lower end of the tube 10.

A circular disk 19 has its peripheral edge located within the circumferential groove so that the disk is rotatable within tube 10. An external apertured wall 21 extends right-angularly from disk 19 along the midplane of the disk. Wall 21 serves as a handle for rotating the disk. A circular hole 23 extends through wall 21 for attachment of the lipstick dispenser to a key chain (not shown). Disk 19 and wall 21 are preferably formed as a one piece plastic member.

Attached to disk 19 is an elongated tubular actuator 25, preferably formed of metal. One or two helical slots 27 extend through the wall of the actuator. A cup-shaped holder 29 is floatably arranged within actuator 25 for supporting a lipstick 31. FIG. 1 shows the lipstick in a depleted (shortened) condition. The lipstick is initially longer than as shown in FIG. 1.

one or two cylindrical pins 33 extend from holder 29 through helical slots 27 into the axial grooves in tube 10. With this arrangement it is possible to manually move holder 29 up and down along the tube 10 axis. The woman grasps tube 10 in one hand and applies a rotary force to wall 21 with the other hand. During non-use periods the dispenser is closed by a cylindrical cap 35.

The principal feature of this invention is the rotary disk 19 and apertured wall 21. Wall 21 serves as a turning handle and also as an attachment means for connecting the lipstick dispenser to a key chain.

The drawings show the diameter of the dispenser as relatively large in relation to the dispenser length; this is for the purpose of showing structural details. In the actual dispenser the length dimension will be several times the diameter dimension.

I claim:

1. A lipstick dispenser comprising an axially elongated cylindrical tube having a first end and a second end, said tube comprising a cylindrical sleeve and a cylindrical liner having a friction fit within the sleeve, said liner having an axial slot extending therealong, said liner having one end thereof spaced from the corresponding end of the sleeve to form an internal circumferential groove at said first end of the tube; a circular disk located within said first end of the tube with a peripheral edge thereof rotatably seated in said circumferential groove, an external flat wall extending axially from said disk along a diametrical midplane of the disk, a hole extending transversely through said flat wall for attachment of the dispenser to a key chain; a tubular actuator affixed to said disk, said actuator extending from said disk within said cylindrical tube; a helical slot in said tubular actuator; a lipstick holder floatably arranged within said actuator; and a pin extending from said holder through said helical slot into said axial slot, whereby manual rotation of the disk relative to the cylindrical tube causes the lipstick holder to move axially between the first and second ends of the tube.

* * * * *